US011596276B2

(12) United States Patent
Palutis

(10) Patent No.: US 11,596,276 B2
(45) Date of Patent: Mar. 7, 2023

(54) BATHROOM SPACE SAVER AND ORGANIZER

(71) Applicant: Custom Environmental Consulting LLC, McKinney, TX (US)

(72) Inventor: Jeffrey R. Palutis, McKinney, TX (US)

(73) Assignee: Custom Environmental Consulting LLC, McKinney, TX (US)

( * ) Notice: Subject to any disclaimer, the term of this patent is extended or adjusted under 35 U.S.C. 154(b) by 49 days.

(21) Appl. No.: 17/226,583

(22) Filed: Apr. 9, 2021

(65) Prior Publication Data

US 2022/0322892 A1 Oct. 13, 2022

(51) Int. Cl.

| | |
|---|---|
| ***A47K 10/10*** | (2006.01) |
| ***A47K 10/38*** | (2006.01) |
| *A47K 10/32* | (2006.01) |

(52) U.S. Cl.

CPC ..... *A47K 10/38* (2013.01); *A47K 10/10* (2013.01); *A47K 2010/3233* (2013.01); *A47K 2010/389* (2013.01)

(58) Field of Classification Search

CPC ..... A47K 10/38

See application file for complete search history.

(56) References Cited

U.S. PATENT DOCUMENTS

| | | | |
|---|---|---|---|
| 2,407,971 | A | 9/1946 | Black |
| 2,784,847 | A | 3/1957 | Holroyd |
| 3,271,090 | A | 9/1966 | Smithers |
| D249,308 | S | 9/1978 | Williams |
| D257,082 | S | 9/1980 | Williams |
| 4,444,359 | A | 4/1984 | Butler |
| D292,546 | S | 11/1987 | Tegner |
| D300,703 | S | 4/1989 | Miels |
| 5,570,938 | A | 11/1996 | Butler |

(Continued)

FOREIGN PATENT DOCUMENTS

| | | | |
|---|---|---|---|
| CN | 2766747 | Y | 3/2006 |
| KR | 200388691 | Y1 | 7/2005 |
| KR | 200446447 | Y1 | 11/2009 |

OTHER PUBLICATIONS

Matos, Taina, Patent Cooperation Treaty International Search Report, dated Jun. 29, 2022.

(Continued)

*Primary Examiner* — Gene O Crawford
*Assistant Examiner* — Ayodeji T Ojofeitimi
(74) *Attorney, Agent, or Firm* — Scott L. Harper; Harper & Bates LLP

(57) ABSTRACT

The Bathroom Space Saver and Organizer is a modular unit consisting in part of a prefabricated box frame manufactured from wood, plastic, marble, stone, or other suitable material which can be easily installed in existing homes or new homes to enhance aesthetics and the usefulness of storage in a bathroom. Various storage media, such as toilet paper roll holders, shelving, hooks, sliding drawers and cabinetry may be configured within the box frame to provide an array of storage options for the user. The invention may be preconfigured and manufactured in a variety of dimensions and shapes, including rectangular, square, oval and arched among other possible shape configurations. Decorative trims and other ornamental features may be provided to enhance the design aesthetic.

16 Claims, 8 Drawing Sheets

(56) References Cited

U.S. PATENT DOCUMENTS

| | | | | |
|---|---|---|---|---|
| 5,704,565 | A * | 1/1998 | Cheng | A47K 10/38 242/597.7 |
| 6,047,920 | A | 4/2000 | Dearwester | |
| 6,163,898 | A | 12/2000 | Misch | |
| 6,315,237 | B1 | 11/2001 | Hoerner | |
| 7,374,128 | B2 | 5/2008 | Hendrix et al. | |
| 7,407,237 | B2 * | 8/2008 | Bright | A47B 67/02 312/294 |
| D701,393 | S | 3/2014 | Boeltl | |
| 9,408,504 | B1 * | 8/2016 | Cordeau | A47K 10/38 |
| D827,326 | S | 9/2018 | Sealey | |
| 10,638,890 | B2 | 5/2020 | Miranda et al. | |
| 2007/0018544 | A1 | 1/2007 | Bright | |
| 2007/0095769 | A1 | 5/2007 | Jenkins | |
| 2011/0215008 | A1 | 9/2011 | Carroll | |
| 2012/0067837 | A1 | 3/2012 | He et al. | |
| 2012/0091163 | A1 * | 4/2012 | Lowry | A47F 1/082 221/92 |
| 2012/0111989 | A1 * | 5/2012 | Dermo | A47K 10/40 242/598 |
| 2014/0124287 | A1 * | 5/2014 | Fishberger | A61B 7/02 221/26 |
| 2014/0166803 | A1 | 6/2014 | Choe | |
| 2016/0150921 | A1 | 6/2016 | Shea | |
| 2017/0009936 | A1 * | 1/2017 | Lan | A47G 1/17 |
| 2018/0353017 | A1 | 12/2018 | Miranda et al. | |

OTHER PUBLICATIONS

Matos, Taina, Patent Cooperation Treaty Written Opinion of the International Searching Authority, dated Jun. 29, 2022.

* cited by examiner

BATHROOM SPACE SAVER AND ORGANIZER

BACKGROUND

The concept of a typical toilet paper holder creates many design flaws as it is installed to stick out and extend away from a bathroom wall. Typical holders are attached to drywall that can be weak, flimsy and cause the toilet paper holder to loosen or break away from a fixed position. The typical installed toilet paper holder is prone to being hit and bumped into causing issues and repair or frustration as loose handles move from wear and tear. Some major issues, concerns, and installation challenges surrounding prior art toilet paper holders include the difficulty in properly anchoring the holder to the drywall and still protect the holder from being bumped into, pulled, and loosened from a secure, fixed position due to systematic wear and tear. Another issue commonly encountered is the lack of available space to install toilet paper holders or other storage media in current bathrooms, which creates added concerns and installation challenges. Many home designs have small or private rooms for a toilet that lack space for a typical toilet paper holder to be attached to the adjacent wall and limits available storage or areas for shelves in the water closet area.

The invention disclosed herein provides an adequate surface and enclosure on which a toilet paper holder and personal item storage enclosure may be fixedly secured, while also creating a space to secure the toilet paper holder to avoid being hit or bumped into by the user. Additionally, multiple inventive embodiments of the invention disclosed herein include space and design considerations to provide for built-in shelves, cabinets, or sliding drawers for decorative advantages and storing personal items.

This invention will allow unused space between the 2'×4" joists in wall supports or other material used to support the drywall in any bathroom. The Space Saver Organizer is intended to be designed and constructed in different dimensions to fit between the drywall supports in typical residential and apartment construction enhancing the storage and use for toilet paper and other bathroom amenities and will give the sufficient strength to the toilet paper holder as it will be secure and attached to the recessed box frame that is stronger and more durable than drywall. Various configurations of the Space Saver invention can be designed to fit between wall supports to hang bathroom robes, wash cloths and/or towels while adding unique decorative advantages as disclosed herein.

SUMMARY OF THE INVENTION

The Bathroom Space Saver and Organizer, hereinafter the "Space Saver," is a modular unit consisting in part of a prefabricated box frame manufactured from wood, plastic, marble, stone, or other suitable material which can be easily installed in existing homes or new homes to enhance aesthetics and the usefulness of storage in a bathroom. Various storage media, such as toilet paper roll holders, shelving, hooks, sliding drawers and cabinetry may be configured within the box frame to provide an array of storage options for the user. The invention may be preconfigured and manufactured in a variety of dimensions and shapes, including rectangular, square, oval and arched among other possible shape configurations. Decorative trims and other ornamental features may be provided to enhance the design aesthetic.

The invention is intended to use and take advantage of the unused space existing between the wall stud supports in the walls forming a bathroom or water closet enclosure. This allows the modular Space Saver unit to be placed and securely fixed within the wall space and recessed within a wall of the bathroom or water closet. The Space Saver stores supplies or other items in a decorative enclosure and allows the user to select from a variety of configurations and accessories of the Space Saver modular unit, such as one or more shelves, a periodical holder, one or more toilet paper roll holders or a storage space cabinet with door, allowing the user to choose the accessories and compartments for the Space Saver appropriate to their individual needs.

BRIEF DESCRIPTION OF THE DRAWINGS

The details of one or more implementations are set forth in the drawings included in this application and which are further described below. Other features, objects, and advantages of the invention embodiments disclosed herein will be apparent from the description and figures.

DETAILED DESCRIPTION

Figure 1A:
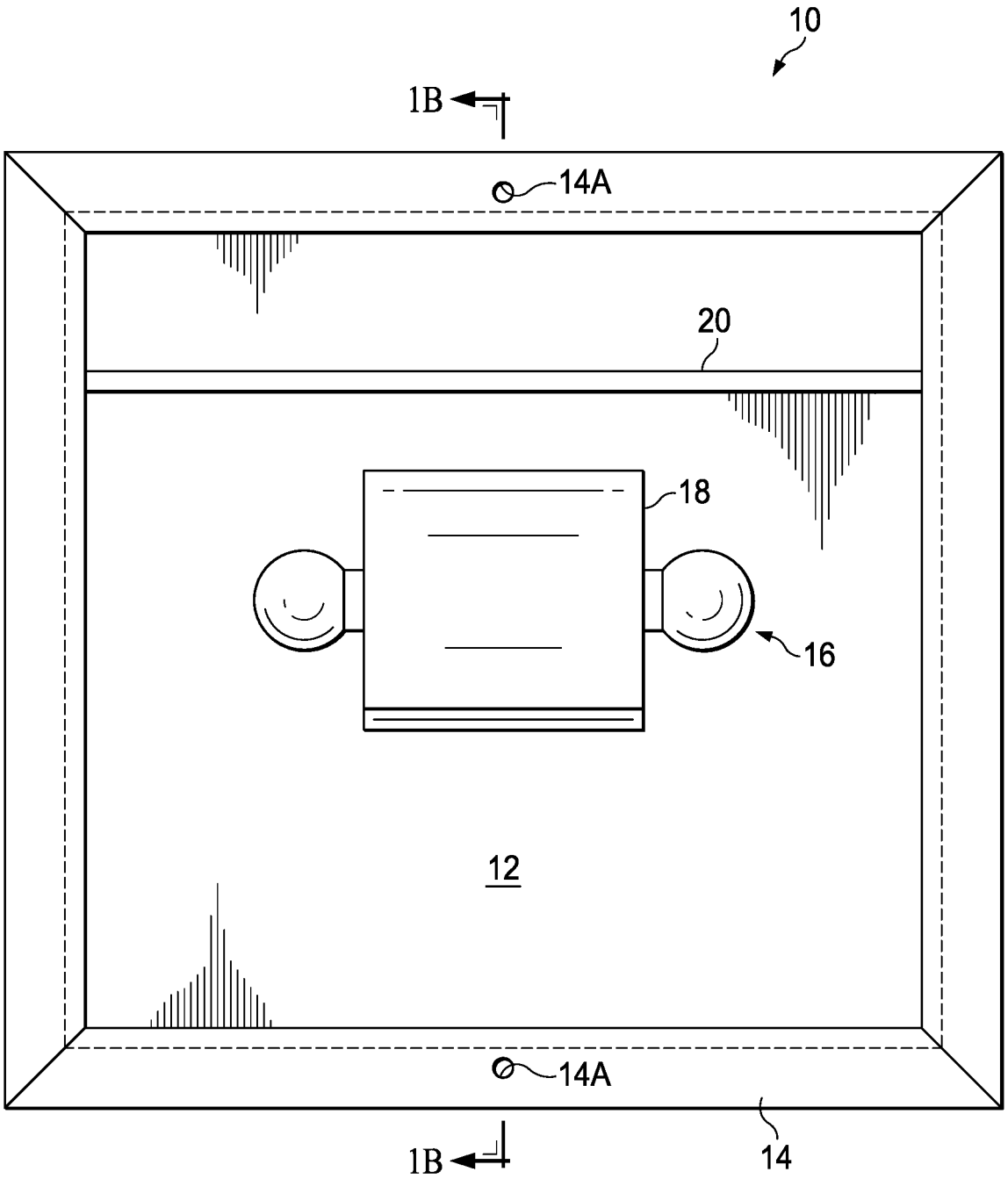
FIG. 1A is a front view of an embodiment of the Space Saver invention disclosed herein.
Figure 1B:
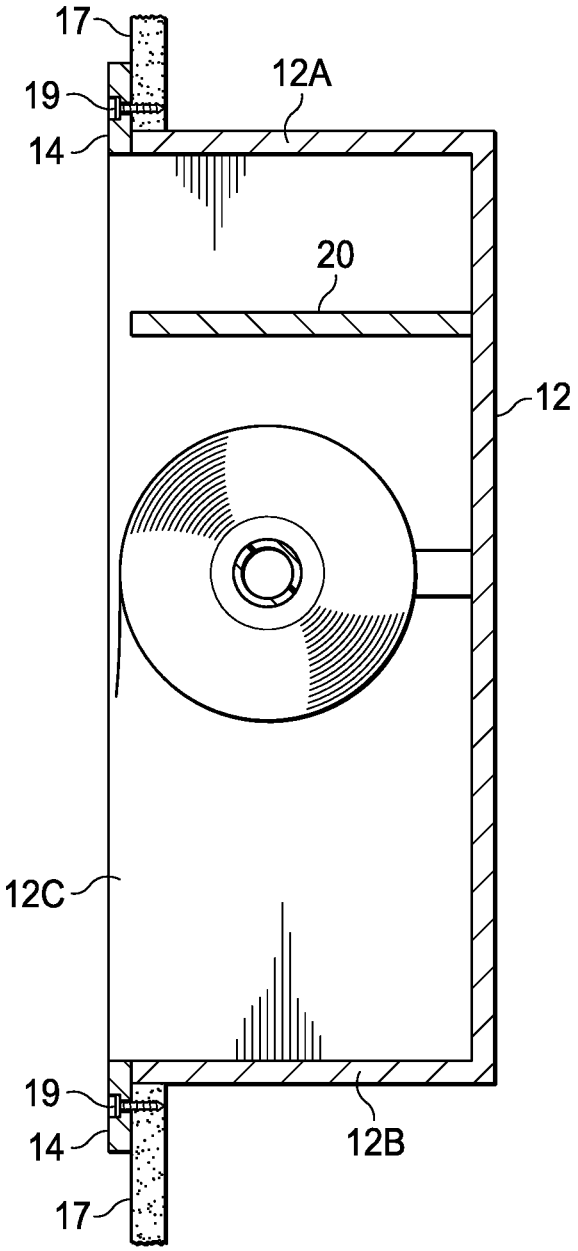
FIG. 1B is a side view of an embodiment of the Space Saver invention disclosed herein.

Turning to FIGS. 1A and 1B, the Space Saver invention 10 is shown having a generally rectangular back panel 12 fastened with left and right-side panels 12C and 12D (not shown), and with top panel 12A and bottom panel 12B to form an open box enclosure. The panels forming the box enclosure may be fastened together with adhesives, screws, nails, staples or other fastening means as is known in the art. Decorative trim 14 is attached to the front edges of panels 12A, 12B, 12C and 12D to cover any gaps formed between the box enclosure and the sheetrock or other wall covering, and decorative trim 14 also serves to provide an ornamental feature to the Space Saver invention 10. Decorative trim 14 may also include pre-formed holes 14A through which the Space Saver invention may be secured in place to wall 17 with an adhesive to the back of trim 14 or with screws, nails, or other fastening means 19 as is known in the art.

A roll holder 16 capable of holding and dispensing toilet paper 18 is shown secured to back panel 12. A variety of roll holders 16 may be used with the Space Saver 10 with individual styles selectable by the user for use with the décor in their habitation. Shelf 20 is shown configured with the Space Saver 10 invention. In an embodiment, shelf 20 is secured to the one or more of panels 12, 12C and 12D (not shown) in a fixed or detachable method, allowing for the user to fix shelf 20 in place or to adjust the height placement of shelf 20 within the confines of the Space Saver 10.

Figure 2A:
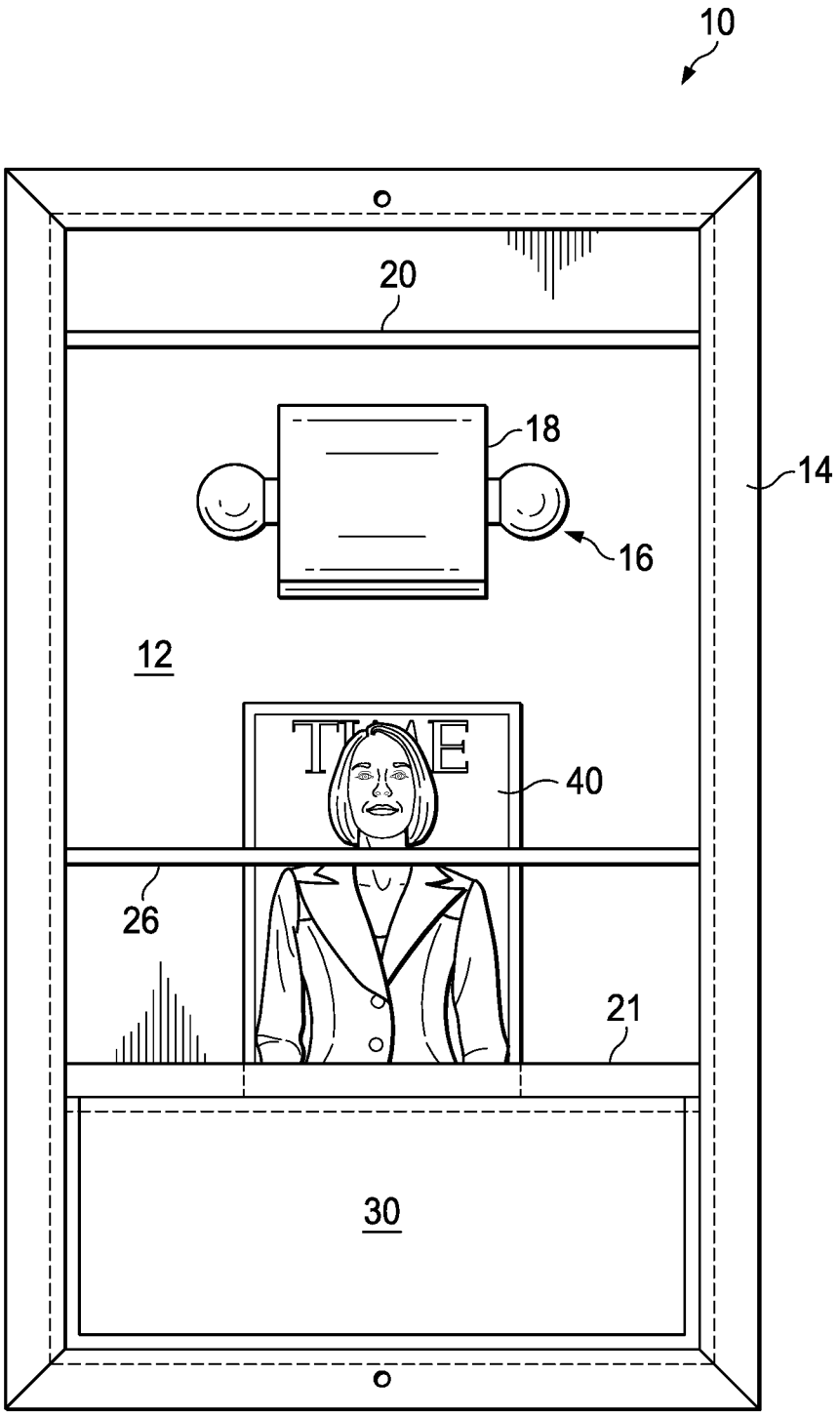
FIG. 2A is a front view of an alternative embodiment of the Space Saver invention disclosed herein.
Figure 2B:
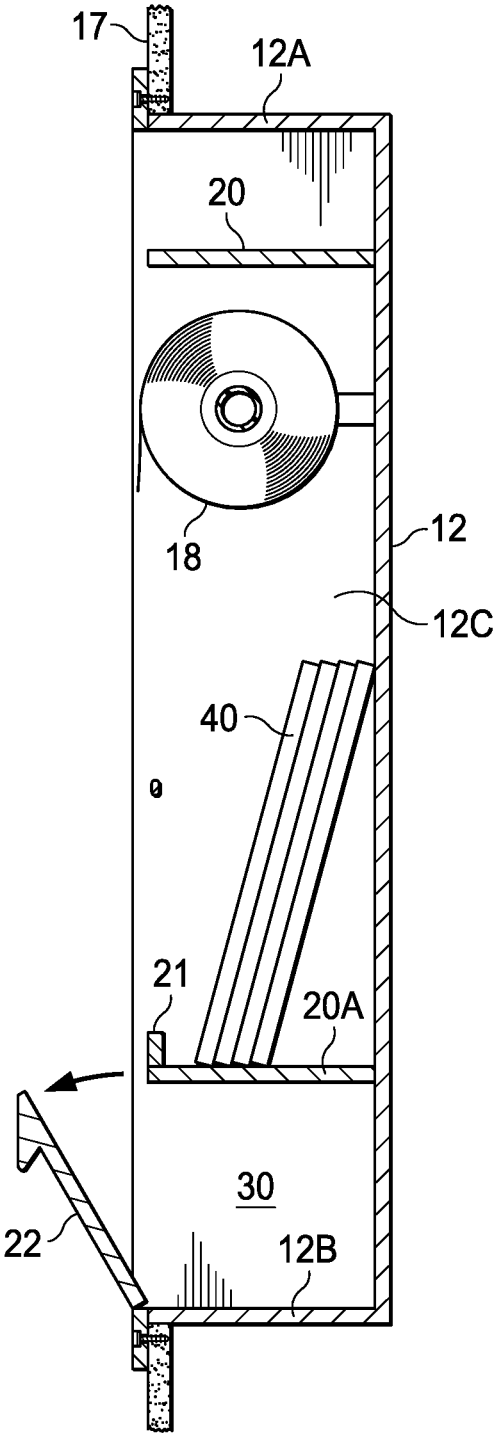
FIG. 2B is a side view of an alternative embodiment of the Space Saver invention disclosed herein.
Figure 2C:
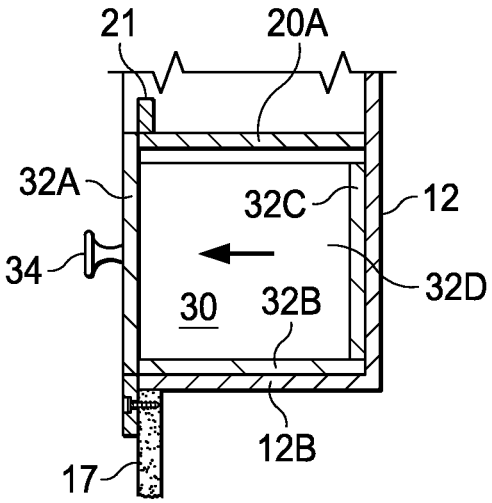
FIG. 2C is a side view a storage drawer compartment embodiment of the Space Saver invention disclosed herein.

With reference to FIGS. 2A-2C, an alternative embodiment of the Space Saver 10 is depicted. In this embodiment, Space Saver 10 includes upper shelf 20, roll holder 16, lower shelf 20A with attached shelf lip 21 and retention rod 26 for storing periodicals and newspapers 40, and an enclosed storage space 30. Shelf lip 21 is secured to shelf 20A and provides, along with retention rod 26, a configuration to retain and store periodicals 40 within the Space Saver 10 and provide easy access to the user while the bathroom is in use. Storage compartment 30 is comprised of the space formed between shelf 20A and panels 12, 12B, 12C, 12D and door 22. Storage compartment 30 is accessed by opening and closing door 22 that is hingeably connected to either trim 14 (as shown) or to bottom panel 12B in other contemplated embodiments.

Storage compartment 30 may be used to store hygiene products, toilet paper or other personal items. In an alternative embodiment shown in FIG. 2C, storage compartment 30 is formed between panels 20A, 32B (bottom), 32C (back end), 32D (left side), 32E (right side) with door 32A fixed to the edges of panels, 32B, 32D, and 32E so as to form a slidable drawer that a user may extend or retract by gripping drawer pull 34. In forming this "drawer" configuration, drawer panels 32A, 32B, 32C, 32D, 32E may be securely attached to each other with dovetail joints, adhesives, and other metal or wood fastening means as is known in the art.

Figure 3:
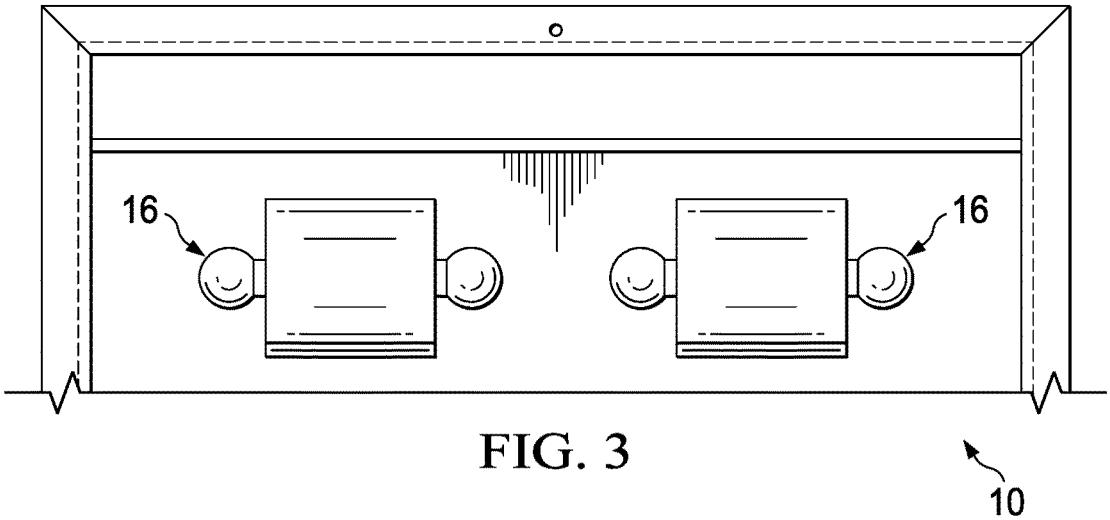
FIG. 3 is a partial front view of an alternative embodiment of the Space Saver invention disclosed herein.
Figure 4:
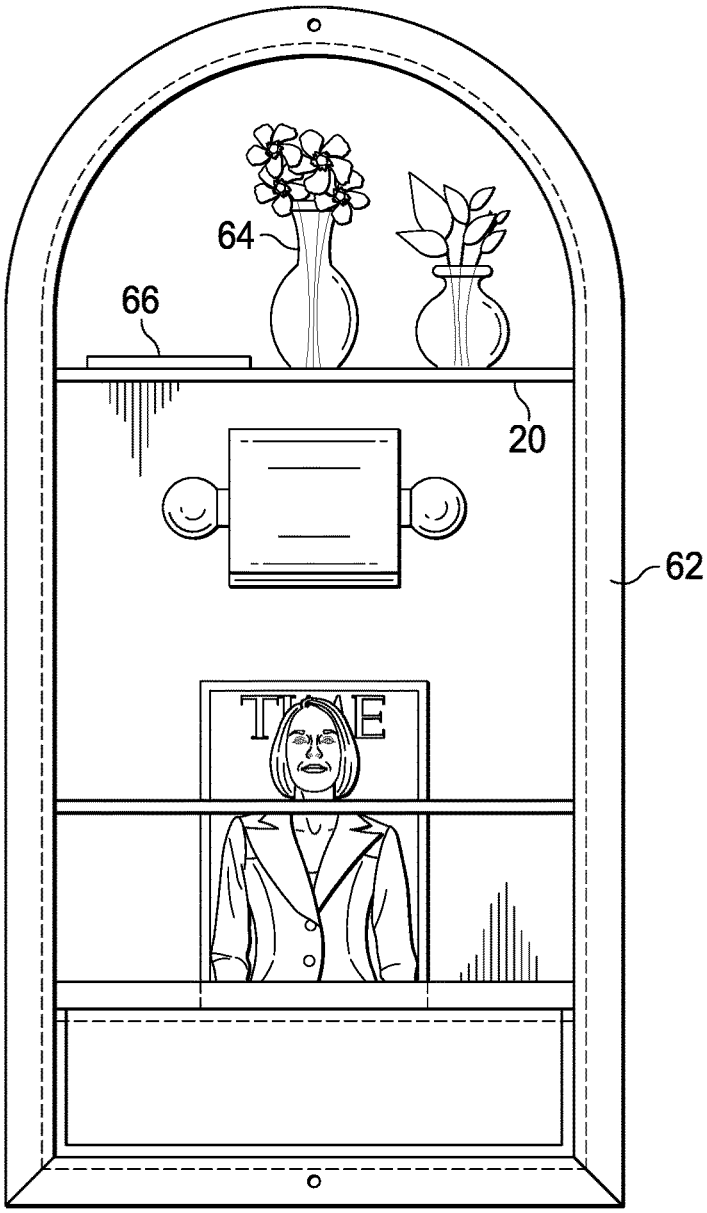
FIG. 4 is a front view of an alternative embodiment of the Space Saver invention disclosed herein.

FIG. 3 depicts an alternative embodiment of the Space Saver 10 wherein two roll holders 16 are shown as part of the Space Saver 10. FIG. 4 is an alternative embodiment of the Space Saver 60 with an "arched" top design 62 as shown. In this embodiment, shelf 20 along with the arched top 62 provide ample space for a user to store and display decorative items such as flowers 64 and personal accessories such as a phone 66 while the user is within the bathroom.

Figure 5:
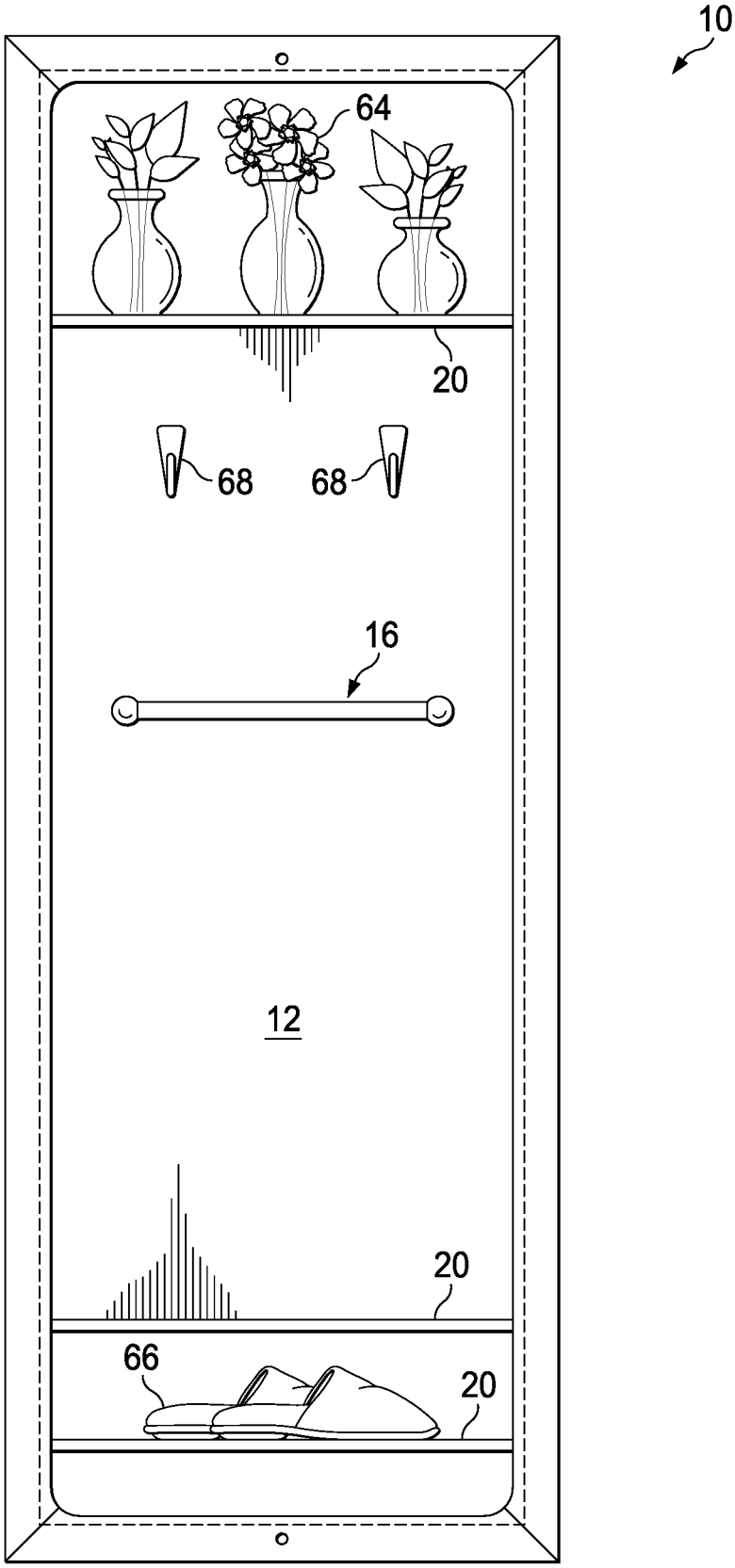
FIG. 5 is a front view of an alternative embodiment of the Space Saver invention disclosed herein.
Figure 6A:
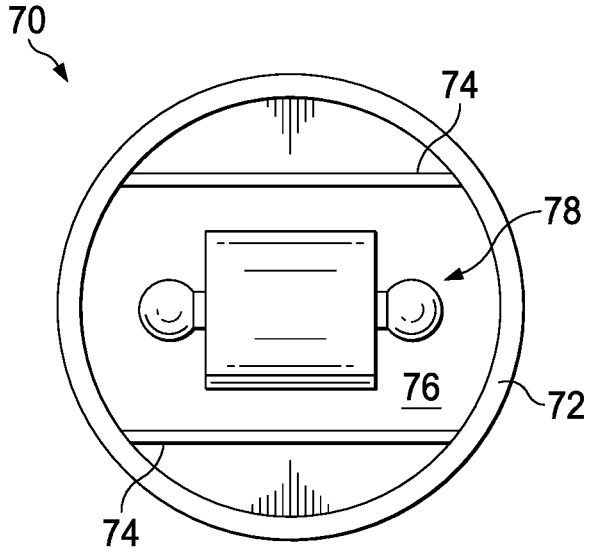
FIG. 6A and FIG. 6B are front views of alternative embodiments of the Space Saver invention disclosed herein.
Figure 6B:
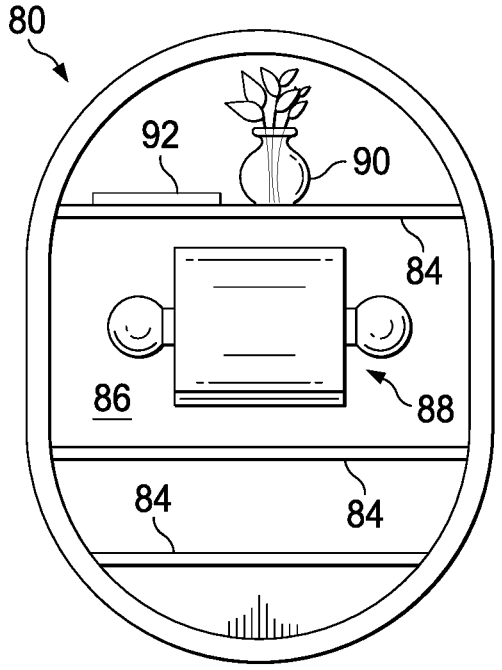

FIGS. 5, 6A and 6B depict alternative embodiments of the Space Saver 10. FIG. 5 depicts an embodiment of the Space Saver 10 that includes three shelves 20 for supporting and storing items such as decorative flowers 64 and footwear 66. In contemplated embodiments, shelves 20 may be configured to support other items such as a beverage container, jewelry, watches, mobile phones, air freshener or timepieces and the like. Hooks 68 and towel bar 16 are attached to back panel 12 and provide additional storage capability from which a user may hang items, such as jewelry, hand towels, towels, robes or other items while the user is within the bathroom. FIG. 6A depicts Space Saver 70 in an ornamental circle design. Trim 72 and enclosure 76 are fashioned in a substantially circular shape. Shelves 74 and roll holder 78 provide surfaces upon which personal items may be stored and toilet paper dispensed from enclosure 76. With reference to FIG. 6B, an alternative embodiment of the Space Saver 80 is shown in an ornamental oval design. Trim 82 and enclosure 86 are fashioned in a substantially oval shape. Shelves 84 and roll holder 88 provide surfaces upon which personal items, such as book 92 and flowers 90 may be placed and securely stored within the oval shaped enclosure 86.

Figure 7A:
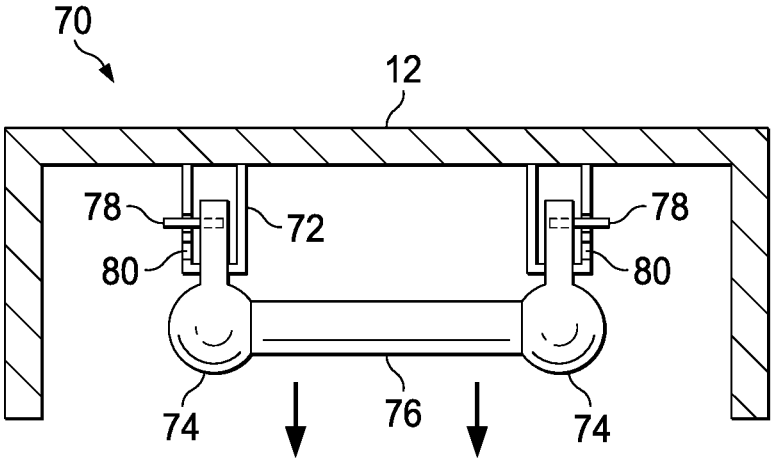
FIG. 7A and FIG. 7B are top plan views of alternative embodiments for a paper roll holder which may be used in accordance with the invention disclosed herein; and, FIG. 7C is a side view of the alternative embodiments for a paper roll holder shown in FIGS. 7A-7B which may be used in accordance with the invention disclosed herein.
Figure 7B:
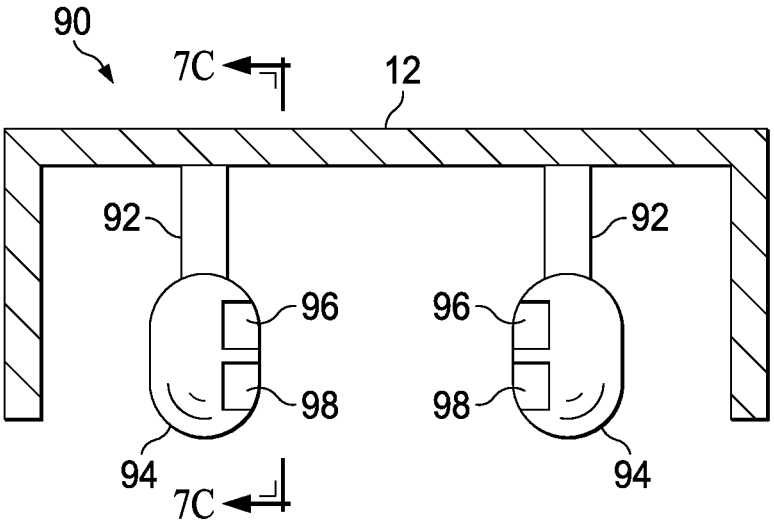

FIGS. 7A and 7B disclose alternative embodiments of a paper roll holder which may be used in connection with the invention disclosed herein. FIG. 7A discloses an adjustable roll holder 70 capable of accepting and holding standard and oversize paper rolls. Roll holder 70 is comprised of three elements including receivers 72, stems 74, and cross rod 76. Receivers 72 are secured to back panel 12 by fastening means as known in the art, such as by screw fasteners or adhesives. Stem pins 78 are located on or near a terminating end of stems 74 and stem pins 78 include an extendible/retractable mechanism which provides a detachable connection of stems 74 into receivers 72 whereby the stems 74 are inserted into receivers 72 until stem pins 78 encounter and extend through pin holes 80 located in receivers 78. Stems 74 are thereby secured to receivers 72 and operative to support cross rod 76 in a fixed position between stems 74. A variety of pin holes 80 may be pre-formed in axially, spaced increments along the length of the opposing receivers to provide a range of adjustable stem 74 lengths to accommodate the variable circumference of a paper roll (not shown) being held in place and support by cross rod 76. When the paper roll requires replacement, the user retracts stem pins 78 by pushing stem pins 78 into the interior volume of corresponding receivers 72 then gently pulls stems 74 and cross rod 76 away from receivers 72 until stems 74 are clear and removed from contact with receivers 72. The user may then remove and replace the paper roll and insert the stems 74 into receivers 72 until stem pins 78 encounter and extend through pin holes 80 and which allow adequate clearance between the circumferential perimeter of the paper roll (not shown) and the back panel 12.

FIG. 7B discloses an alternative embodiment of a paper roll holder 90 that may be used with the invention disclosed herein. Receivers 92 are secured to back panel 12 by fastening means as known in the art, such as by screw fasteners or adhesives. Receivers 92 include opposing rod blocks 94 secured to a terminal end of each receiver 92. Rod blocks 94 include pre-formed notches 96, 98 formed to accept and detachably secure a cross rod (not shown) capable of supporting regular and oversize paper rolls. In the depicted embodiment, the user places the cross rod through the interior of a paper roll, positions and inserts the cross rod into the corresponding opposing notches 96, 98 as appropriate to provide support for the paper roll with clearance between the circumferential perimeter of the paper roll and the back panel 12. The user may then remove and replace the paper roll by lifting the cross rod (not shown) out of and away from notches 96, 98, remove and replace the expended roll on the cross rod and then place the terminal ends of the cross rod into notches 96, 98 as appropriate.

Figure 7C:
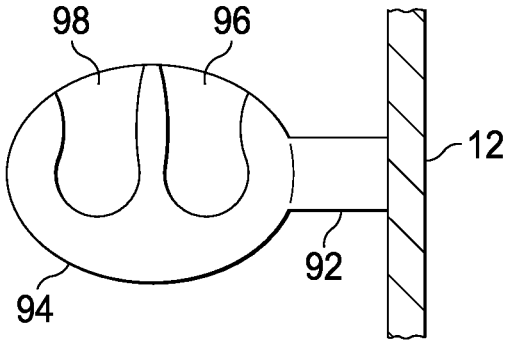

FIG. 7C is a representative side view of an embodiment of the paper roll holder 90 with receivers 92 as shown in FIG. 7B. In this particular view, a single receiver 92 is shown for ease of reference. Receiver 92 is secured to back panel 12 by fastening means as known in the art, such as by screw fasteners or adhesives. Receiver 92 includes rod block 94 secured to a terminal end of receiver 92. Rod block 94 includes pre-formed notches 96, 98 formed to accept and detachably secure a cross rod (not shown) capable of supporting regular and oversize paper rolls. In the depicted embodiment, the user places the cross rod through the interior of a paper roll, positions and inserts the cross rod into the corresponding opposing notches 96, 98 as appropriate to provide support for the paper roll with clearance between the circumferential perimeter of the paper roll and the back panel 12. The user may then remove and replace the paper roll by lifting the cross rod (not shown) out of and away from notches 96, 98 remove and replace the expended roll on the cross rod and then place the terminal ends of the cross rod into notches 96, 98 as appropriate depending on the size of the paper roll (i.e. "regular" or "oversize").

Installation of the Space Saver modular unit 10 is quite simple whether being retrofitted into existing construction or installed in new construction bathrooms and water closets. In one embodiment, a section of wall covering, such as sheetrock, is cut in a dimension large enough to allow for the insertion of the Space Saver box unit and the cut portion removed from the wall thereby exposing the interior space existing in the wall between wall studs. The Space Saver is then inserted into the cut-out portion until the trim portion of the Space Saver comes into contact with the sheetrock wall covering around the periphery of the Space Saver box unit. The Space Saver is then secured to the wall with adhesives, screws, nails, or other fastening means as is known in the art. The user may then place personal items, hygiene items, decorative items, and toilet paper within the storage spaces and roll dispensers located in or on the Space Saver.

It is to be understood that the implementations disclosed herein are not limited to particular apparatus or methods described which may, of course, vary. Moreover, the invention defined by the above paragraphs is not to be limited to particular details set forth in the above description, as many apparent variations thereof are possible without departing from the spirit or scope of the present disclosure. It is also to be understood that the terminology used herein is for the purpose of describing particular implementations only and is not intended to be limiting.

I claim:

1. A bathroom space saver apparatus, comprising:

an enclosure including a planar back panel with at least two side panels, a top panel and a bottom panel attached to and extending orthogonally in a first direction away from the back panel, and defining an interior box enclosure;

at least one shelf secured within a portion of the box enclosure and extending in the first direction away from the back panel between the two side panels;

a paper roll holder detachably secured to mounted to the back panel, wherein the paper roll holder includes at least two stems with a stem pin located near a terminating end of each stem and a crossrod detachably secured between the two stems.

2. The apparatus of claim 1 further comprising:

a decorative trim attached to an edge of the two side panels, top panel and bottom panel for securing the enclosure to a bathroom wall.

3. The apparatus of claim 1 further comprising:

a second shelf and a retention rod secured within a portion of the box enclosure configured to support and retain at least one periodical.

4. The apparatus of claim 1 further comprising:

a drawer secured within a portion of the box enclosure.

5. The apparatus of claim 1 further comprising:

a cabinet formed within a portion of the box enclosure wherein a door to the cabinet is hingeably attached to a trim or a panel forming part of the box enclosure.

6. The apparatus of claim 1 further comprising:

a hook attached to the back panel of the box enclosure.

7. The apparatus of claim 1 further comprising:

a towel bar attached to the back panel of the box enclosure.

8. The apparatus of claim 1 wherein the stem pins are retractable.

9. The apparatus of claim 1 wherein each stem is secured into a receiver attached to the back panel of the box enclosure.

10. A method for storing accessories in a bathroom space saver, wherein the space saver comprises an enclosure including a planar back panel with at least two side panels, a top panel and a bottom panel attached to and extending orthogonally in a first direction away from the back panel, and defining an interior box enclosure wherein at least one shelf is secured within a portion of the box enclosure and extending in the first direction away from the back panel between the two side panels, and wherein a paper roll holder is detachably secured to the back panel of the interior box enclosure, the method comprising:

retracting at least two stem pins into the interior volume of at least two corresponding receivers;

pulling the stems and a crossrod away from the receivers;

removing the used paper roll from the crossrod and placing a new paper roll secured by the crossrod between the two stems; and, retracting the two stem pins and inserting the stems into the receivers until the stem pins encounter and extend through corresponding pin holes located in the corresponding receivers.

11. The method of claim 10 further comprising:

securing the space saver to a wall with a decorative trim attached to an edge of the two side panels, top panel and bottom panel of the space saver.

12. The method of claim 10 wherein a hook is attached to the back panel of the box enclosure for hanging one of a towel, a robe, or a jewelry item.

13. The method of claim 10 further comprising:

storing personal or hygiene items in a drawer secured within the space saver.

14. The method of claim 10 further comprising:

storing personal or hygiene items in a cabinet secured within the space saver.

15. The method of claim 10 further comprising:

displaying a decorative item on the shelf secured within the box enclosure.

16. The method of claim 10 further comprising:

storing a periodical within a portion of the box enclosure.

* * * * *